US008097109B2

(12) United States Patent
McNeil

(10) Patent No.: US 8,097,109 B2
(45) Date of Patent: Jan. 17, 2012

(54) METHOD FOR THE CONCURRENT CONVERTING OF MULTIPLE WEB MATERIALS

(75) Inventor: Kevin Benson McNeil, Loveland, OH (US)

(73) Assignee: The Proctor & Gamble Company, Cincinnati, OH (US)

( * ) Notice: Subject to any disclaimer, the term of this patent is extended or adjusted under 35 U.S.C. 154(b) by 812 days.

(21) Appl. No.: 11/012,009

(22) Filed: Dec. 14, 2004

(65) Prior Publication Data

US 2006/0124229 A1 Jun. 15, 2006

(51) Int. Cl.
*B31F 1/00* (2006.01)
*B32B 38/04* (2006.01)

(52) U.S. Cl. ..... 156/200; 156/204; 156/250; 156/271; 493/405

(58) Field of Classification Search ..... 156/226, 156/227

See application file for complete search history.

(56) References Cited

U.S. PATENT DOCUMENTS

| | | | | | |
|---|---|---|---|---|---|
| 368,705 | A | * | 8/1887 | Colley | 242/526.1 |
| 3,248,102 | A | | 4/1966 | Couzens et al. | |
| 3,505,154 | A | * | 4/1970 | Logrippo | 428/37 |
| 3,603,521 | A | | 9/1971 | Ormsby | |
| 3,676,270 | A | * | 7/1972 | Lehmacher et al. | 156/553 |
| 3,719,442 | A | | 3/1973 | Schippers et al. | |
| 3,779,475 | A | | 12/1973 | Plevin | |
| 3,791,266 | A | | 2/1974 | Bucalo | |
| 3,853,279 | A | | 12/1974 | Gerstein | |
| 3,858,821 | A | * | 1/1975 | Beard et al. | 242/530.3 |
| 4,181,270 | A | | 1/1980 | Laar et al. | |
| 4,759,512 | A | | 7/1988 | Gaiser | |
| 5,336,677 | A | | 8/1994 | Sarantakis et al. | |
| 5,620,151 | A | | 4/1997 | Ueyama et al. | |
| 5,842,663 | A | | 12/1998 | O'Connor et al. | |
| 5,909,856 | A | | 6/1999 | Myer et al. | |
| 5,942,080 | A | * | 8/1999 | Mortellite et al. | 156/461 |
| 5,974,993 | A | | 11/1999 | DeFranks et al. | |
| 6,059,219 | A | | 5/2000 | Kayser et al. | |
| 6,168,558 | B1 | | 1/2001 | Vinberg | |
| 6,299,098 | B1 | | 10/2001 | Hayata | |
| 6,656,401 | B1 | | 12/2003 | Knauf | |
| 2002/0084100 | A1 | * | 7/2002 | Angell et al. | 174/116 |
| 2003/0160127 | A1 | | 8/2003 | Wojcik et al. | |
| 2003/0167943 | A1 | | 9/2003 | Izawa et al. | |

(Continued)

FOREIGN PATENT DOCUMENTS

EP 0 309 659 B1 4/1989

(Continued)

*Primary Examiner* — John Goff
*Assistant Examiner* — Barbara J Musser
(74) *Attorney, Agent, or Firm* — Peter D. Meyer; David K. Mattheis

(57) ABSTRACT

An apparatus for the concurrent converting of multiple web products includes at least a first unwind station and a second unwind station. The apparatus further includes a first web transformation station associated with a first web material unwound from the first unwind station, and a second web transformation station associated with the second web material unwound from the second unwind station. The first and second web transformation stations are disposed such that less than twice the width of the widest web material separates a portion of the first web material in the first web transformation station from a portion of the second web material in the second web transformation station. The method of the invention includes steps of unwinding web materials from rolls at each of the first and second unwind stations and transforming the respective web materials using the first and second web transformation stations.

10 Claims, 9 Drawing Sheets

FOREIGN PATENT DOCUMENTS

| | | |
|---|---|---|
| EP | 0 538 052 A1 | 4/1993 |
| EP | 0 721 904 A1 | 7/1996 |
| WO | WO 98/37794 | 9/1998 |
| WO | WO 99/16951 | 4/1999 |

* cited by examiner

METHOD FOR THE CONCURRENT CONVERTING OF MULTIPLE WEB MATERIALS

FIELD OF THE INVENTION

The present invention relates to apparatus and methods for the concurrent converting of multiple web materials. Specifically, the invention relates to apparatus and methods for the independent and concurrent conversion of multiple rolls of web material.

BACKGROUND OF THE INVENTION

Many products are the result of the processing of a web material. Paper webs, woven and non-woven textiles, metal foils, and polymeric films may each be processed from a web material into a variety of products.

The economic processing of these web materials may require the use of large diameter and large width rolls of base web materials. This processing commonly occurs on equipment dedicated to a particular base web material operated by a crew of operations personnel dedicated to the particular processing equipment. Considerations affecting the relative spacing of the respective processing equipment associated with independently processed web materials generally include the provision and removal of the base web material and any other material required for the processing of the web materials. As the rolls of base materials become larger, the relative spacing of the processing equipment also tends to become larger.

Increasingly reliable processing methods and equipment may require less than the full time attention of operating personnel. The relative spacing of processing equipment may preclude a single operator from efficiently interacting with multiple web transformation stations. Improving the efficiency and economics of processing operations may require more effectively utilizing the time of operations personnel. Achieving this improvement may require the interaction of individual operations personnel with transformation stations of multiple web materials.

Accordingly a need exists for an apparatus and method for processing multiple web materials that provides a configuration enabling a more efficient utilization of the available time of operating personnel.

SUMMARY OF THE INVENTION

In one aspect the invention comprises an apparatus for the concurrent converting of multiple web products. The apparatus comprises at least a first unwind station and a second unwind station. The unwind stations respectively unwind first and second web materials from rolls of these materials. The apparatus further comprises either web processing stations for each web or a web processing station adapted to receive the first web material from the first roll unwinding station and the second web material from the second roll unwinding station. The first web material comprises a first width and the second web material comprises a second width. The web processing station winds the first web material into a first product having a third width and the second web material into a second product distinct from the first product and having a fourth width. The sum of the third width and the fourth width is less than the sum of the first width and the second width. The first and second web materials are disposed in the web processing station such that as the first web material and the second web material are wound by the web processing station, a portion of the first web material is less than twice the greater of the first width and the second width from a portion of the second web material in the web processing station.

In another aspect the invention comprises a method for using the apparatus for the converting of a first web material into a first product and concurrently converting a second web material into a second product. The method comprises steps of unwinding a first web material having a first width at a first web unwinding station and unwinding a second web material having a second width from a second web unwinding station. The method also includes steps of reducing the effective width of one web material, and winding each of the web materials into a wound product. In one embodiment, less than twice the width of the wider of the first web material and the second web material separates a portion of the first web material in from a portion of the second web material as the web materials are wound.

BRIEF DESCRIPTION OF THE DRAWINGS

While the claims hereof particularly point out and distinctly claim the subject matter of the present invention, it is believed the invention will be better understood in view of the following detailed description of the invention taken in conjunction with the accompanying drawings in which corresponding features of the several views are identically designated and in which:

DETAILED DESCRIPTION OF THE INVENTION

Figure 1:
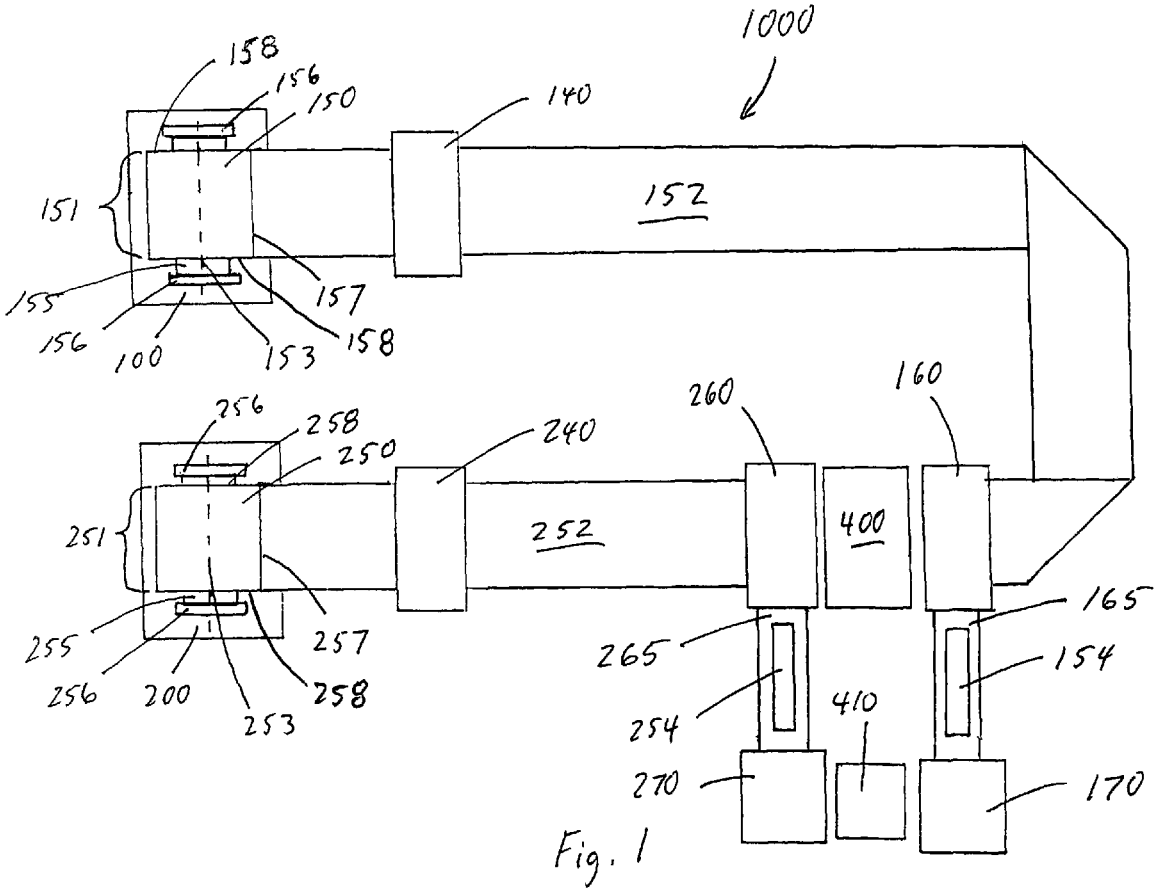
FIG. 1 schematically illustrates a plan view of an apparatus according to one embodiment of the invention.

According to FIG. 1, apparatus 1000 comprises a first unwind station 100 and a second unwind station 200. The apparatus 1000 may further comprise additional unwind stations (not shown). One of skill in the art understands the following description of the first unwind station 100 to apply as well to the second unwind station 200 and to any additional unwind stations.

The first unwind station 100 may comprise any unwind mechanism known to those of skill in the art. The first unwind station 100 may unwind a first roll 150 of a first web material 152. The generally cylindrical first roll 150 has a first circumferential surface 157, opposed first end surfaces 158, and a first winding axis 153. In one embodiment the first web material 152 of the first roll 150 may convolutedly wrap around a first core 155. The first unwind station 100 may support a cored first roll 150 via first core chucks 156 known to those of skill in the art.

In another embodiment, the apparatus 1000 may process coreless first rolls 150. Contact between the unwind station 100 and the first circumferential surface 157 and/or first end surfaces 158 may support the first roll 150.

The size of the first roll 150 does not limit the invention. Exemplary first roll 150 size ranges include rolls having diameters from about 1 cm to about 300 cm and roll widths from about 1 cm to about 500 cm. In one embodiment, the first roll 150 has a diameter of about 250 cm and a width of about 250 cm. The processing of large rolls having diameters and/or widths in excess of 200 cm may provide particular economic and efficiency benefits.

The first roll 150 may rotate to unwind the first web material 152. In one embodiment the first core chucks 156 may center drive and rotate the first roll 150. The first core chucks 156 may engage the first core 155 of the first roll 150 as known to those of skill in the art. In another embodiment a surface drive element (not shown) may contact and transfer torque to the first circumferential surface 157 thus rotating the first roll 150. In another embodiment the first roll 150 may rotate under the influence of drive elements (not shown) contacting the first end surfaces 158. Combinations of surface, end, and center drives may also rotate and unwind the first roll 150.

The first roll 150 may have a vertical or horizontal orientation. A horizontal orientation describes a first roll 150 having the first winding axis 153 disposed substantially horizontally. A vertical orientation describes a first roll 150 having the first winding axis 153 disposed substantially vertically.

Roll transport means (not shown) known to those of skill in the art may transport the first roll 150 to the first unwind station 100. Roll transport means include, without being limiting, automatic guided vehicles, manually operated lift trucks, roll conveying systems, and directly coupling the first unwind station 100 to a web production operation (not shown).

The first web material 152 and second web material 252 may comprise any web material known to those of skill in the art. The first web material 152 comprises a first width 151 and the second web material 252 comprises a second width 251. Exemplary web materials 152, 252 include, without being limiting, metal foils such as aluminum, tin, gold, and steel foils, polymeric films such as polyester, co-polyester, nylon, and other polymeric films, woven textiles and non-woven substrates, paper web such as tissue paper, newsprint, and heavier grades of paper, as well as wires, threads, yarns and similar materials. In one embodiment the first web material 152 and the second web material 252 comprise identical or substantially similar web materials. In an alternative embodiment the first web material 152 and the second web material 252 may comprise substantially dissimilar web materials. As an example of the latter embodiment, the first web material 152 may comprise a polymeric film while the second web material 252 comprises a paper web material. The nature of the respective web materials 152, 252 does not limit the scope of the invention.

The first web material 152 unwinds from the first roll 150 via the first unwind station 100 and proceeds toward a first converting station 160. Ancillary web handling equipment (not shown) interposed between the first unwind station 100 and the first converting station 160 may interact with the first web material 152. The ancillary web handling equipment may facilitate the transfer of the first web material 152 from the first unwind station 100 to the first converting station 160. This ancillary web handling equipment may include, without being limiting, web-supporting idler rollers and intermediate drive roller, web turning rollers, air-bar web turning elements, tension sensing rollers, web supporting belts, airfoils and web spreaders.

The first web converting station 160 may receive the first web material 152 and may convert the first web material 152 as known to those of skill in the art. Converting, as used herein, describes performing a transformative operation on a web material such that the converted web material demonstrably differs from the unconverted web material. Exemplary converting operations include, without being limiting: printing, embossing, calendering, laminating, folding, slitting, perforating, stacking, and winding. A converting station as used herein describes an apparatus capable of performing any known converting operation, and also includes web inspection apparatus.

Any of the herein described web converting stations may process web materials having the cross-machine direction of the web material oriented substantially horizontally or oriented substantially vertically. In the embodiment illustrated in FIG. 1, the first web converting station 160 comprises a combination converting station that perforates, winds, and separates the first web material 152 into discrete first logs 154 of web material 152. These first logs 154 of web material 152 may subsequently be conveyed from the first web converting station 160 via a first log conveyor 165 to one or more subsequent web converting stations 170. Subsequent web converting stations 170 disposed to accept the first logs 154 from the first web converting station 160, and to further process the first logs 154 may comprise, log saws, bundlers, wrappers, stackers and other web converting equipment known to those of skill in the art.

In one embodiment, the first web converting station 160 may receive the first web material 152 directly from the first web unwind station 100, or via ancillary web handling elements described above. In the embodiment illustrated in FIG. 1 the first web converting station 160 receives the first web material 152 subsequent to the processing of the first web material 152 by an intermediate converting station 140. As shown in FIG. 1 web material 152 unwinds from roll 150 via the first web unwind station 100. The first web material 152 proceeds from the first roll 150 to an intermediate web converting station 140. The intermediate web converting station 140 processes the first web material 152 prior to passing the first web material 152 to the first web converting station 160. Intermediate web converting station 140 may comprise any converting equipment known to those of skill in the art As an example illustrated in FIG. 1, the first unwind station 100 may unwind a paper towel web material 152 from a first roll 150 of the first web material 152. Successive intermediate web converting stations 140 may emboss the first web material 152 and print a design upon the first web material 152 prior to the transfer of the first web material 152 to the first web converting station 160 for perforating and separation into discrete first logs 154 of the first web material 152.

The description of the web converting stations 140, 160, and 170 for the first web material 152 together with the description of the converting of the first web material 152 applies as well to the web converting stations 240, 260, and 270 and product conveyor 265 together with the converting of the second web material 252 unwound from a second roll 250 comprising a winding axis 253, a circumferential surface 257, end surfaces 258, and a core 255 supported by core chucks 256. In one embodiment, substantial similarities may exist between the web converting stations 240, 260, and 270 and the overall converting of the second web material 252 and the converting stations 140, 160, and 170 together with the overall converting described for the first web material 152. In another embodiment the operations performed by the web converting stations 240, 260, and 270 may differ substantially from those performed by the web converting stations 140, 160, and 170. The extent of any similarity of the web converting stations 140, 160, and 170 and the web converting stations 240, 260, and 270 does not limit the scope of the invention.

The first web converting station 160 and the second web converting station 260 may operate independently each from the other. Independent operation of the first web converting station 160 and the second web converting station 260 refers to the ability to operate each of the web converting stations 160, 260 without any necessity of operating the other web converting station. Independent operation further describes the ability to cease the operation of one web converting station without affecting the continuing operation of the other web converting operation.

In one embodiment, the first and second web converting stations, 160, 260 may operate at least occasionally concurrently. In this embodiment, the first web converting station 160 and the second web converting station 260 may each operate in an intermittent manner or in a continuous manner. An intermittent manner describes an intention to alternate between operating the web converting station and not operating the web converting station in a cyclic manner according to a predetermined operation cycle. A continuous manner describes an intention to operate the web converting operation without planned stoppages. Operating in each of the intermittent and continuous manners may also include unplanned stoppages.

In another embodiment the first and second web converting stations 160, 260 may operate sequentially wherein the operation of one web converting station follows the operation of the other web converting station. In any embodiment, the first web converting station 160 and the second web converting station 260 yield distinct products 154, 254. The distinct products 154, 254 may comprise final products or intermediate products that may subsequently be converted into final products. The distinct products 154, 254 may be similar or dissimilar each to the other.

The first web material 152, second web material 252, first web converting station 160 and second web converting station 260 may each have a machine direction MD and a cross-machine direction CD. The machine direction MD as used herein as it applies to web handling and converting apparatus describes the general direction of the web material movement through web handling apparatus. Machine direction MD applied to the web materials describes the dimension of the web material following the convoluted windings of the roll. The cross-machine direction CD as applied to web handling and converting apparatus describes the direction generally transverse to the direction of web movement through the apparatus. Cross-machine direction CD applied to web materials describes the dimension of the web material transverse to the machine direction MD of the web material and parallel to the width of the roll.

The locations of the first web converting station 160 and the second web converting station 260 may relate each to the other such that a single machine operator may efficiently interact with each of the web converting stations 160 and 260.

In one embodiment, less than twice the greater of the first width 151 and the second width 251 separates at least a portion the first web material 152 being converted by the first web converting station 160 from at least a portion of the second web material 252 being converted by the second web converting station 260. In another embodiment less than the greater of the first width 151 and the second width 251 separates at least a portion of the first web material 152 being converted by the first web converting station 160 from at least a portion of the second web material 252 being converted by the second web converting station 260. In another embodiment less than one half of the greater of the first width 151 and the second width 251 separates at least a portion of the first web material 152 being converted by the first web converting station 160 from at least a portion of the second web material 252 being converted by the second web converting station 260.

Consideration of the first width 151, the size of the first web converting station 160, the second width 251, the size of the second web converting station 260, and the respective interaction requirements of the first and second web converting stations 160, 260 may at least partially determine the relative locations and separation of the first web converting station 160 and the second web converting station 260. Consideration of the respective, material supply and discharge requirements of the first web converting station 160 and the second web converting station 260 may also partially determine the relative locations and separation of the first and second web converting stations 160 and 260.

The disposition of the intermediate converting stations 140, 240 may be similar to that described above for the first and second web converting station 160, 260. The disposition of the subsequent converting stations 170, 270 may also be similar to that described above for the first and second web converting stations 160, 260. Alternatively, the disposition of the intermediate web converting stations 140, 240, and/or the subsequent web converting stations may differ from that described above for the first and second web converting stations 160, 260. FIG. 1 illustrates a subsequent operator's station 410 disposed between subsequent converting stations 170, 270. An intermediate operator's station 420 may be disposed between intermediate converting stations 140, 240.

In one embodiment illustrated in FIG. 1, face-to-face describes the orientation of the first web converting station 160 relative to the second web converting station 260. Face-to-face describes a substantially parallel relationship between the cross-machine direction CD of the first web material 152 as received by the first web converting station 160 and the cross-machine direction CD of the second web material 252 as received by the second web converting station 260 and a disposition of the first web converting station 160 at a location opposed to, and separated from, the position of the second web converting station 260.

According to FIG. 1 an operator's interaction station 400 may separate the first web converting station 160 from the second web converting station 260. The particular requirements of each of the first web converting station 160 and second web converting station 260 may determine the particular details of the operator interaction station 400. These details may include human machine interfaces (not shown) for each of the first web converting station 160 and second web converting station 260. These human machine interfaces may comprise a single human machine interface capable of providing access to each of the web converting stations 160, 260 and potentially providing access to additional elements of the web handling apparatus 1000.

The operator's interaction station 400 may provide access for a process operator to the first web converting station 160 as well as the second web converting station 260. This access may enable the operator to observe the converting process of the first and second web materials 152, 252 as well as enabling the interaction with the web converting stations 160, 260 necessary to correct process faults and to restart the respective web converting stations 160, 260.

Figure 2:
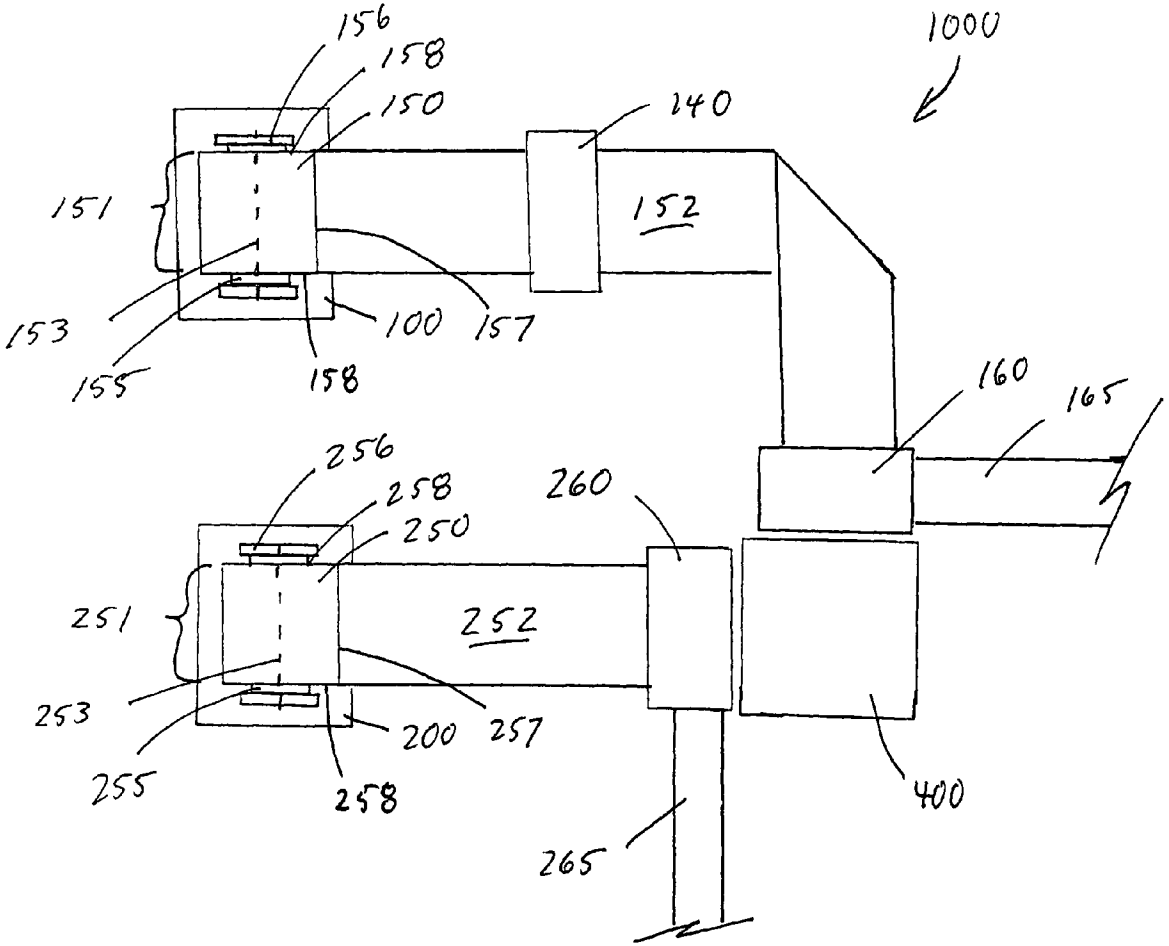
FIG. 2 schematically illustrates a plan view of an apparatus according to another embodiment of the invention.

In another embodiment illustrated in FIG. 2, angular describes the relative orientation of the first web converting station 160 and the second web converting station 260. Angular refers to the orientation of the machine direction MD of the first web material 152 approaching the first web converting station 160 relative to the machine direction MD of the second web material 252 approaching the second web converting station 260. This orientation provides the first web converting station 160 at an angle relative to the second web converting station 260. Exemplary angular separations of the first and second web converting stations 160, 260 include angles from about 5 degrees to about 175 degrees.

Figure 3:
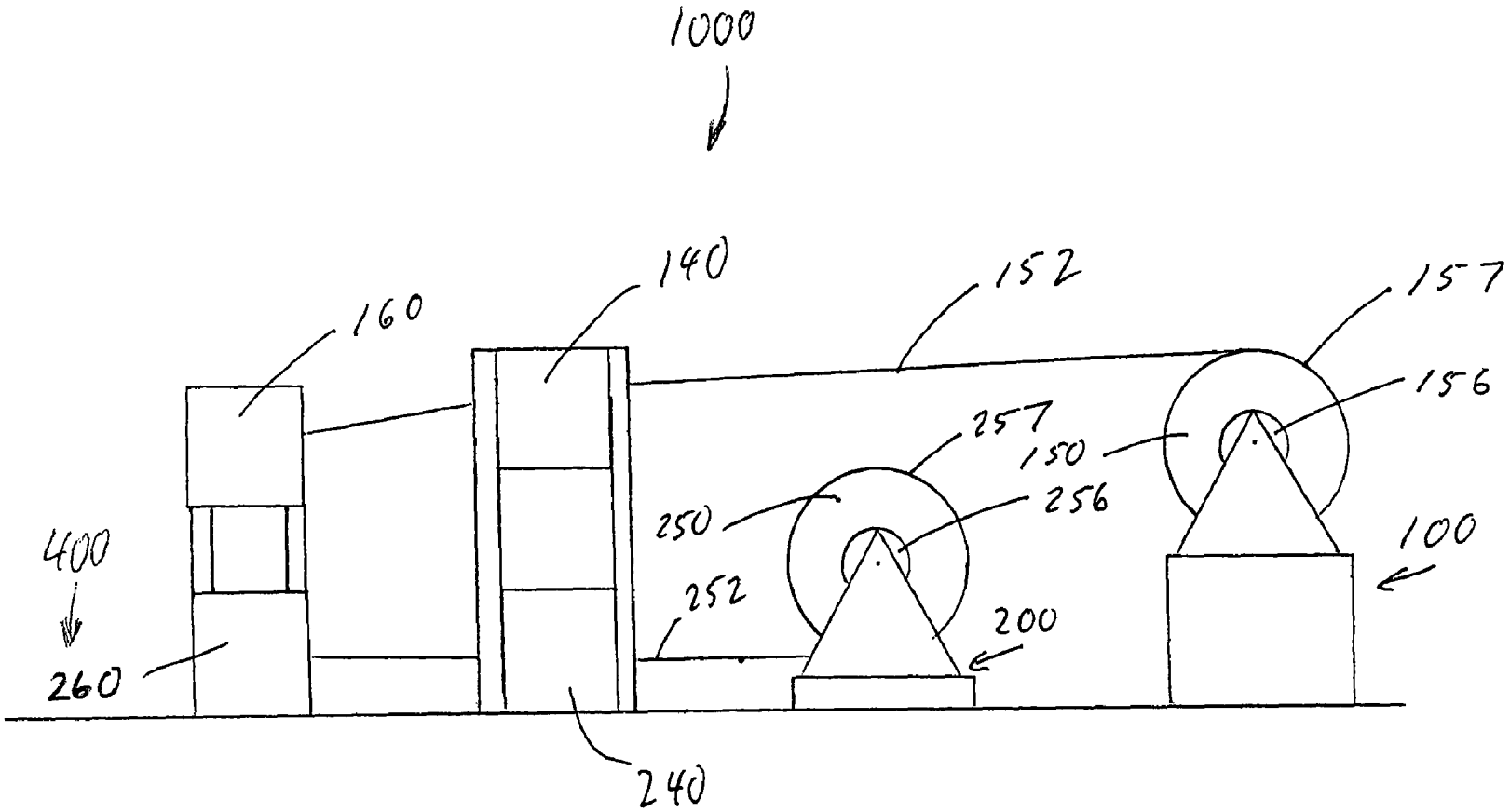
FIG. 3 schematically illustrates a side view of an apparatus according to another embodiment of the invention.

In another embodiment illustrated in FIG. 3 over-and-under describes the orientation of the first web converting station 160 relative to the second web converting station 260. This embodiment provides at least a portion of the first web converting station 160 in a location above at least a portion of the second web converting station 260.

Figure 4:
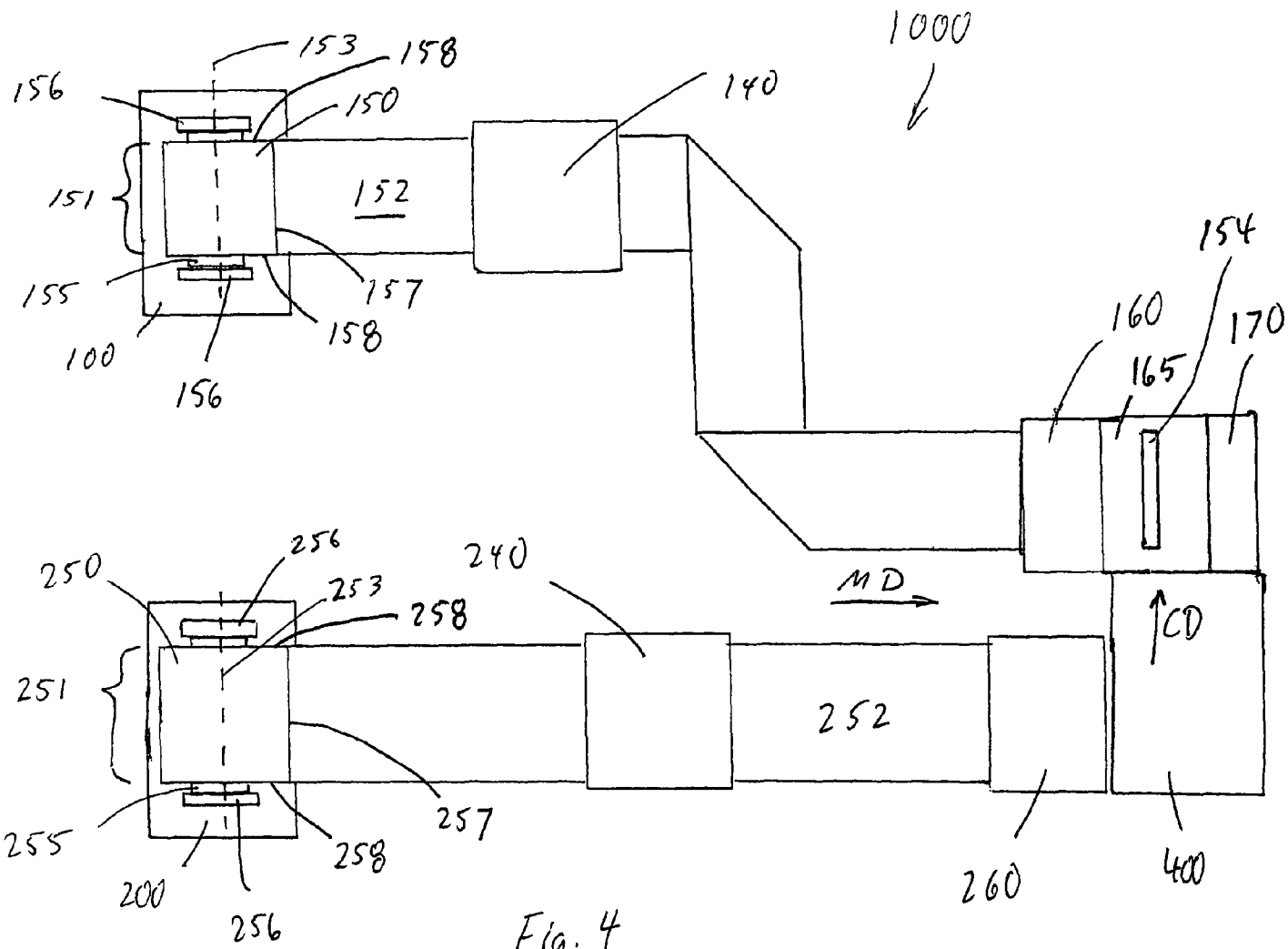
FIG. 4 schematically illustrates a plan view of an apparatus according to another embodiment of the invention.

In another embodiment illustrated in FIG. 4, side-by-side describes the orientation of the first web converting station 160 relative to the second web converting station 260. This embodiment provides the first web converting station 160 in a location parallel to and offset from the second web converting station 260.

In another embodiment, (not shown) at least one of the first and second web converting stations may be configured to process a vertically oriented web material. In the particular configurations of this embodiment, the separation of the first and second web converting stations may be in terms of the widths of the web materials as described above.

In each of these embodiments the first web material 152 and the second web material 252 may respectively approach the first web converting station 160 and the second web converting station 260 along substantially similar web paths from the respective web unwind stations 100, 200. Alternatively the first and second web materials 152 and 252 may approach the first and second web converting stations 160, 260 along substantially dissimilar web paths from the respective unwind stations 100, 200.

Figure 5:
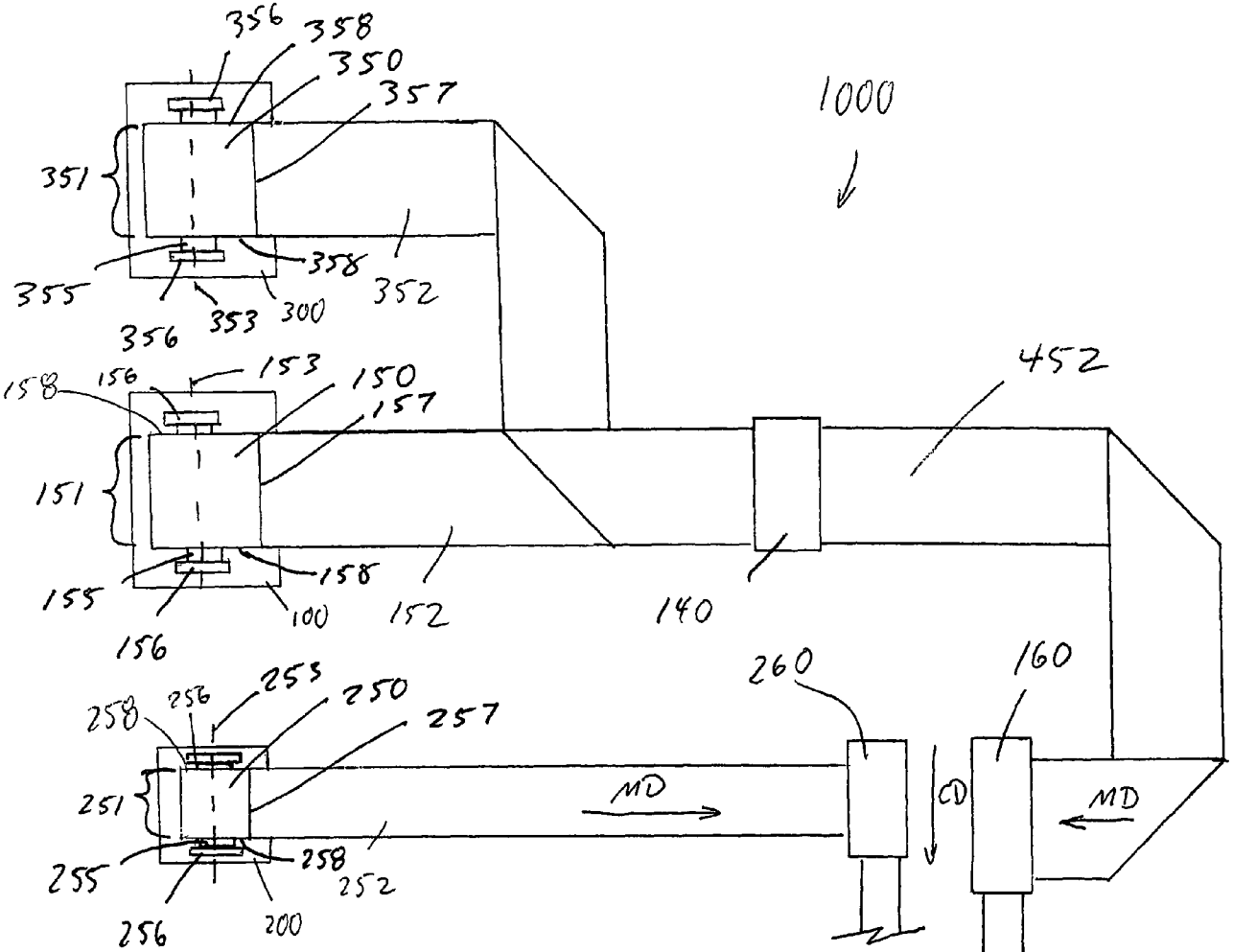
FIG. 5 schematically illustrates a plan view of an apparatus according to another embodiment of the invention.

In another embodiment illustrated in FIG. 5, the apparatus 1000 further comprises a third web unwind station 300. A third web material 352 comprising a third width 351 may unwind from a third roll 350 of the third material 352 comprising a core 355 engaged by core chucks 356, a circumferential surface 357, a winding axis 353, and end surfaces 358, via the third web unwind station 300. The intermediate web converting station 140 may process the third web material 352 together with the first web material 152 to form a two ply web material 452. The first web converting station 160 may subsequently convert the two ply web material 452. In an alternative embodiment (not shown), a subsequent web converting station may combine the third web material with the first web material after the processing of the first web material by the first web converting station.

Figure 6:
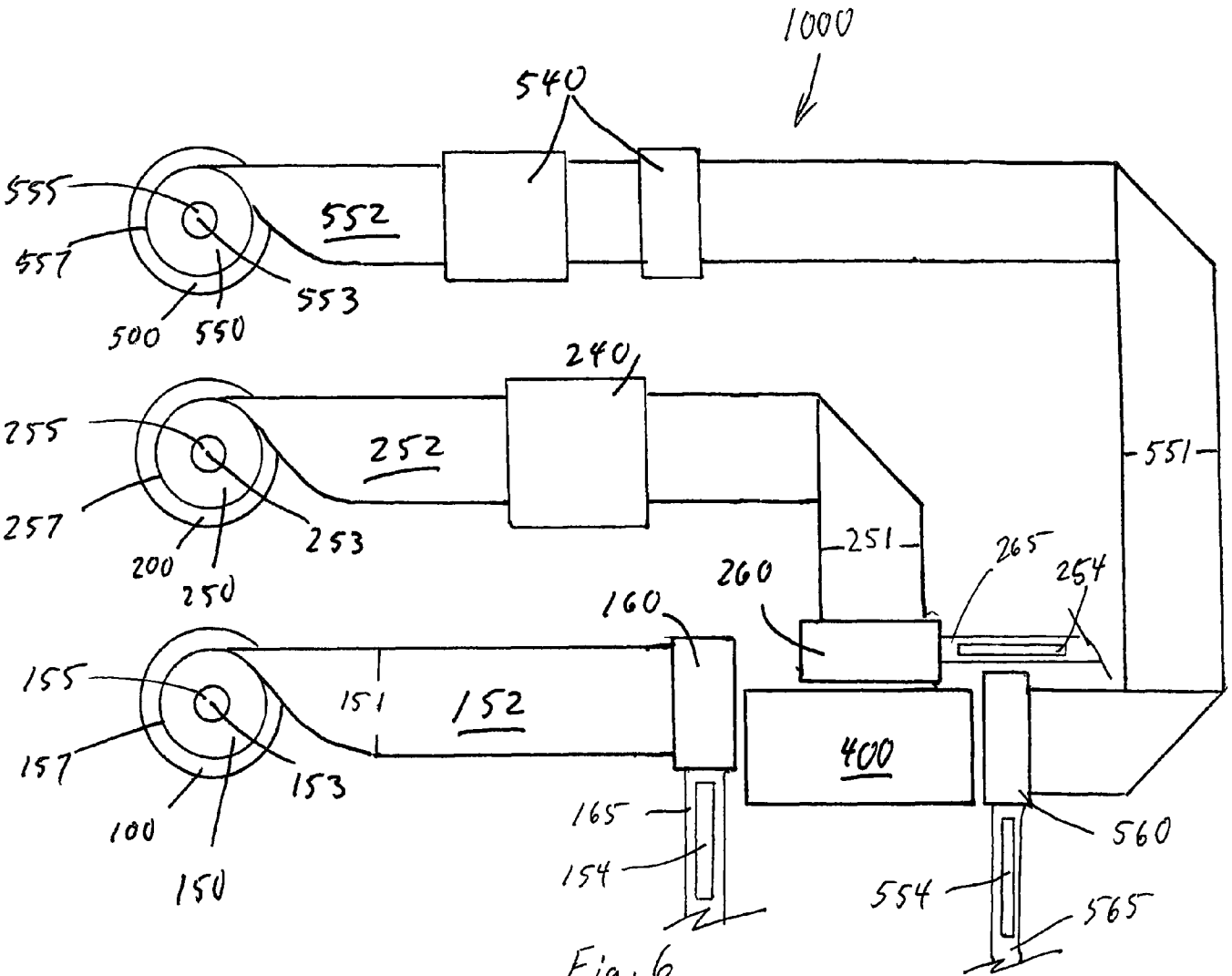
FIG. 6 schematically illustrates a plan view of an apparatus according to another embodiment of the invention.

In another embodiment illustrated in FIG. 6 the apparatus 1000 further comprises an additional unwind station 500. An additional web material 552 having an additional width 551 unwinds from a roll 550 having a core 555, a winding axis 553, and a circumferential surface 557, via the additional unwind station 500. As shown in FIG. 6, intermediate web converting stations 540 may process web material 552 prior to the processing of the web material 552 by web converting station 560. The additional web converting station 560 converts the additional web material 552 into a product 554 distinct from either the first product 154 or the second product 254. In the illustrated embodiment, conveyor 565 transports the product 554 from the additional converting station 560. Less than twice the greatest of the first width 151, the second width 251 or the additional width 551 separates the location of the additional web converting station 560 from the first web converting station 160 and/or the second web converting station 260.

Figure 7:
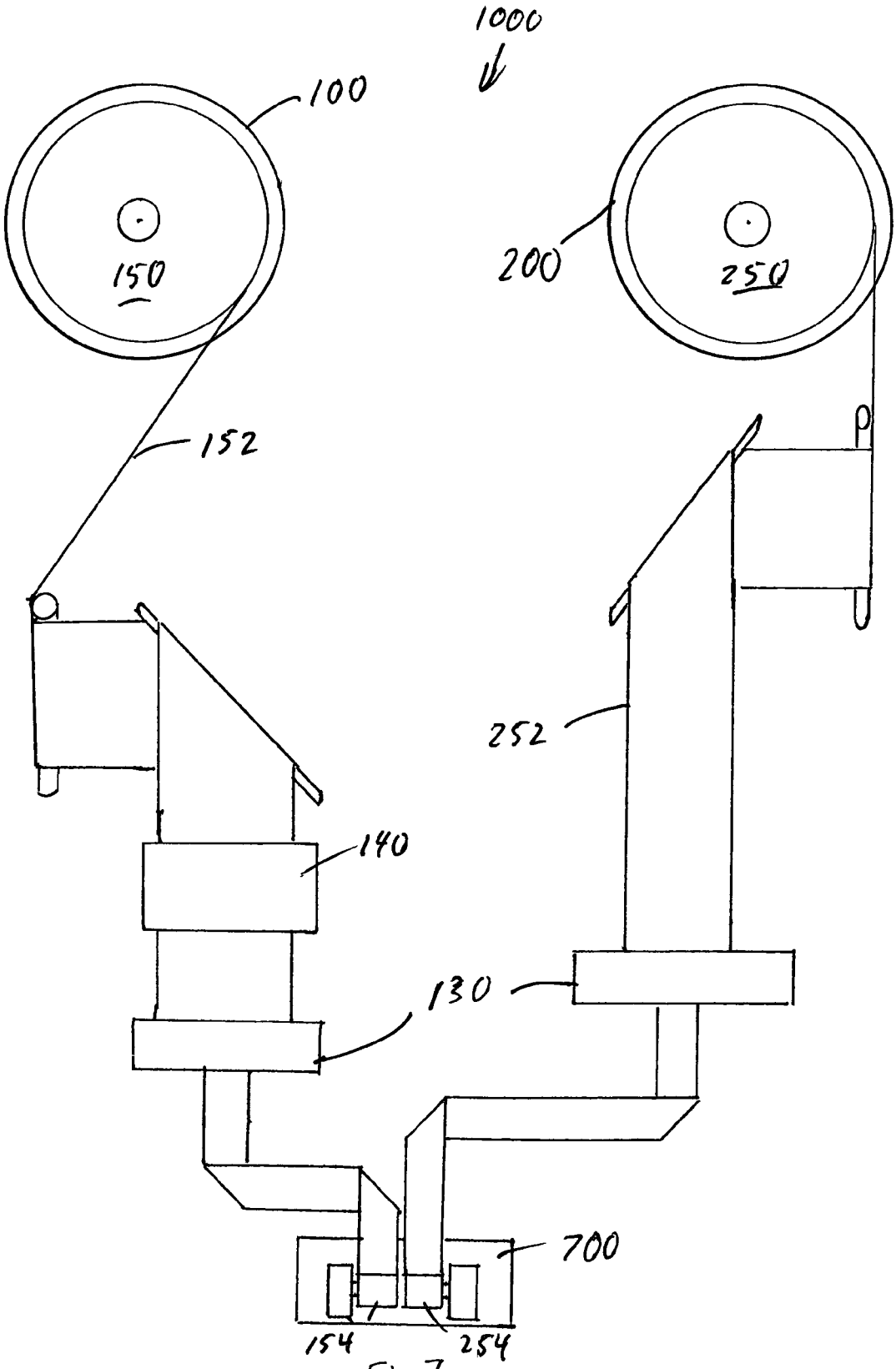
FIG. 7 schematically illustrates a plan view of an apparatus according to another embodiment of the invention.

In another embodiment illustrated in FIG. 7, the apparatus 1000 comprises a web processing station 700 adapted to receive each of the first web 152 and the second web 252. The web processing station 700 may be adapted to wind each of the first web 152 and second web 252 into respective wound roll products 154, 254. The width 151, 251, of at least one of the first and second webs 152, 252, may be reduced prior to the processing of the webs 152, 252, by the web processing station 700. As shown in the figure, each of the first and second webs 152, 252 are reduced by a web transformation station 130 prior to being wound by web processing station 700. The web transformation stations 130 may reduce the width of the web materials by folding, trimming, or transversely deforming the webs as is known in the art. The width 151, 251, may be reduced during the processing of the first and second webs 152, 252, by the web processing station 700.

The width reduction of at least one of the first and second web 152, 252, may be an actual or effective width reduction. An actual width reduction may be accomplished by trimming portions of the web to reduce the web width to a desired magnitude. The reduction in web width may be achieved by deforming the web material. The deformation of the web material may be accomplished by any means known in the art. Exemplary web deformation means include, without being limiting, ring rolling, and embossing the web material. The web material may be stretched along the machine direction. This stretching along the machine direction may cause a narrowing of the web as is known in the art.

Figure 8A:
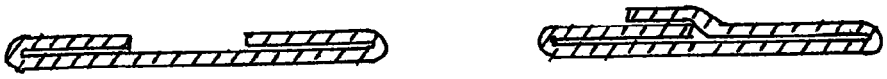
FIG. 8A-8D schematically illustrate cross sectional views of web materials folded according to particular embodiments of the invention.
Figure 8B:
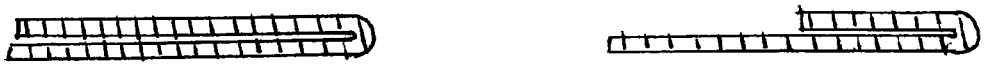
Figure 8C:
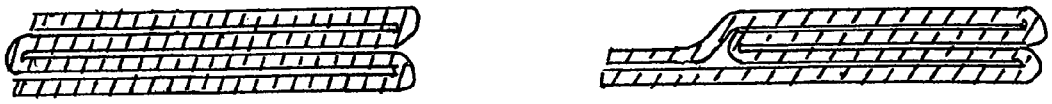
Figure 8D:
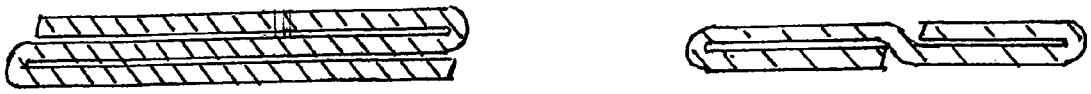

The reduction in the width of the web may be an effective width reduction. An effective width reduction refers to a reduction in the web width as processed by web handling equipment. A folded web has a reduced effective web width. The actual width of the web may remain the same despite a reduction in the effective web width. An effective web width reduction may be accomplished by folding the web. The web may be folded using folding boards or other means as are known in the art. The web may be c folded, z folded, v folded, w folded or folded according to other configurations as are known in the art. FIG. 8 illustrates exemplary non-limiting cross-sectional views of c, v, w and z folded webs viewed along a web section taken in the cross machine direction. FIG. 8*a* illustrates cross-sectional views of c folded webs. FIG. 8*b* illustrates cross-sectional views of v folded webs. FIG. 8*c* illustrates cross-sectional views of w folded web materials. FIG. 8*d* illustrates cross-sectional views of z folded web materials.

C folded web materials may be folded such that the end portions of the fold are of equal length and do not overlap. In anther embodiment the end portions of the c fold may be of equal length and may overlap forming a web portion three layers thick in the area of the overlap. The end portions may also be of dissimilar lengths and may or may not overlap as desired.

The web processing station 700 may be configured such that at least a portion of the first web 152 is closer than the greater of the fist width 151 and the second width 251 from a portion of the second web 252 as the webs 152, 252, are processed by the web processing station 700.

The web processing station 700 may be configured to wind the first and second webs 152, 252, using a common winding axis. The web processing station 700 may alternatively be configured to wind each independent web material upon a distinct winding axis. The webs may be wound using a single drive or using multiple independent drives for each web. In an embodiment using a single drive, the winding of the individual web materials may be independently achieved through the use of appropriate drive separation means such as pneumatic, electric, hydraulic or magnetic clutches as are known in the art. The web processing station 700 may be a continuous motion web winding apparatus or a cyclical motion apparatus as these are known in the art.

Figure 9:
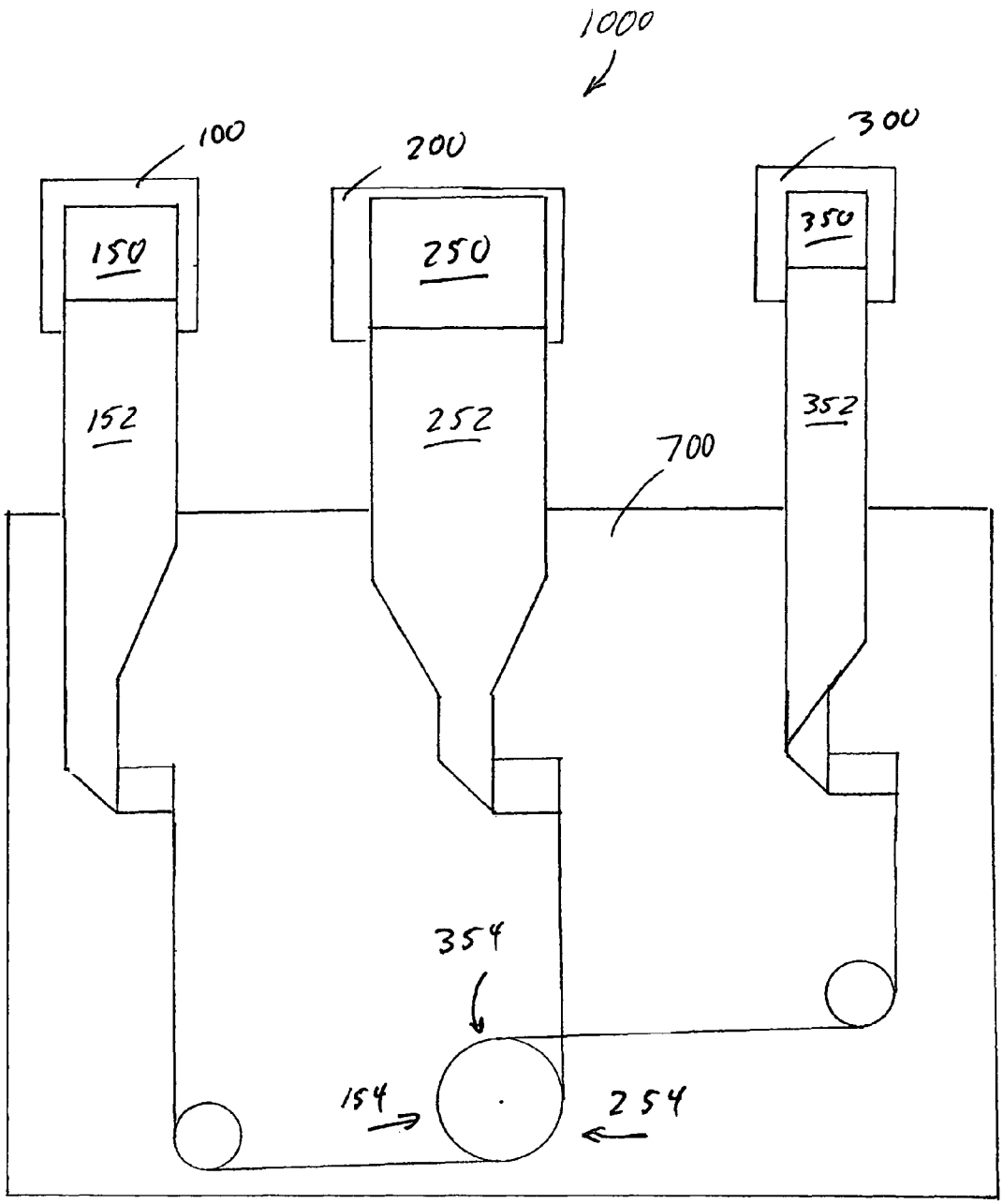
FIG. 9 schematically illustrates a plan view of an apparatus according to another embodiment of the invention.

In the embodiment illustrated in FIG. 9, three rolls of material are unwound by independent roll unwinding stations 100, 200, 300. The three independent web materials 152, 252, 352 are routed to a single web processing station 700. The web processing station 700 receives the three web materials 152, 252, and 352 and winds each of the web materials into a distinct wound roll product 154, 254, 354.

The three webs 152, 252, 352, may be independently converted prior to the winding of the webs. This independent conversion of the webs 152, 252, 352, may be achieved prior to the receipt of the web s by the web processing stations or subsequent to the receipt by the web processing station and prior to the winding of the roll products 154, 254, 354. Each web may be converted in a similar manner. In another embodiment, each web may be converted in a manner dissimilar to the other webs. The selection of the independent converting operations performed to each of the multiple webs does not limit the invention.

The web processing station 700 may be additionally configured to perform other web processing tasks in addition to winding the independent web materials. Exemplary web processing tasks include, without being limiting, folding, perforating, slitting, printing, embossing, laminating, and tail-sealing the web materials.

The web materials may be slit along a straight line or the shape of the slit may have periodic variation. Non-limiting examples of periodic varying slit configurations include sine waves, saw tooth patterns and other repeating patterns. A patterned slit may be achieved through the use of a cutting blade having an edge ground to the desired pattern. The pitch of the desired pattern may be used to determine the circumference of the cutting disk. As an example a pattern having a four inch (10 cm) pitch may be configures on a disk having a circumference that is a multiple of four inches. The position of the disk relative to the web may be adjusted to accommodate disks of differing diameters. Exemplary cutting blades for slitting the web materials may be acquired from Randolph Tool of Hartville, Ohio.

Multiple web materials may be combined prior to winding by the web processing station. In one embodiment (not shown) six rolls of web materials are unwound. The six independent webs are combined into three independent two ply webs. The three independent two ply webs are subsequently wound by a web processing station as described above.

A web processing station 700 adapted to wind multiple independent web materials into distinct products may provide operational efficiencies. The use of the web processing station 700 may enable the processing of multiple web materials by fewer operations personnel than are required by other web processing methods.

Method of Use:

As shown in FIGS. 1-4, the first unwind station 100 may unwind a first roll 150 of first web material 152. The first web material 152 may transfer from the first unwind station 100 to the first web converting station 160. Concurrently, the second unwind station 200 may unwind a second roll 250 of the second web material 252. The second web material 252 may transfer to the second web converting station 260. The proximity of the first and second web converting stations 160, 260 may be expressed in terms of the widths 151, 251 of the first and second web materials 152, 252 as described above.

One embodiment of the method of the invention may utilize the apparatus 1000 illustrated in FIG. 1 and may include providing the first web converting station 160 and the second web converting station 260 such that the two web converting stations 160, 260 are disposed in the previously described face-to-face relationship. This embodiment may provide an operator with efficient access to each of the web converting stations 160, 260. The face-to-face orientation of the web converting stations 160, 260 may permit the operator to observe and interact with each web converting station while also enabling the observation of the other web converting station as well as enabling timely interaction with each web converting station. This configuration of web converting stations 160, 260 may permit an operator to simultaneously view both web converting processes in a single field of view or to alternately observe each process by shifting their field of view from one process to the other.

Another embodiment of the method of the invention performed using the apparatus 1000 illustrated in FIG. 2 may provide the first web converting station 160 and the second web converting station 260 in the above described angular configuration. This configuration may enable the concurrent observation of at least a portion of each web converting process while providing a greater separation of other portions of the respective web converting processes.

In another embodiment utilizing the apparatus 1000 illustrated in FIG. 3 the method of the invention may provide the first web converting station 160 and the second web converting station 260 arranged in the above described over-and-under configuration. In this embodiment, an operator may observe both web converting processes simultaneously in a single field of view, or alternately by shifting their field of view up and down.

In another embodiment utilizing the apparatus 1000 illustrated in FIG. 4 the method of the invention may provide the first web converting station 160 and the second web converting station 260 arranged in the above described side-by-side configuration.

The method of the invention illustrated in FIG. 1 may include the use of additional web converting stations 140, 240, 170 and 270. These additional web converting stations may act upon either the first web material 152 or the second web material 252. In one embodiment illustrated in FIG. 1, intermediate web converting stations 140, 240, may act respectively upon each of the first web material 152 and the second web material 252. In this embodiment the first web material 152 and second web material 252 unwind respectively at the first unwind station 100 and second unwind station 200. Intermediate web converting stations 140, and 240, may act upon the respective first and second web materials 152, 252 before the first web converting station 160 and second web converting station 260 convert the respective web materials 152, 252.

The subsequent web converting stations 170, 270 may act upon the respective web materials 152, 252 after the first web converting station 160 or after the second web converting station 260 respectively.

The method of the invention may further comprise the steps of unwinding a third web material 352 from a third unwind station 300 and of combining the third web material 353 with either of the first web material 152 or the second web material 252 to form a multi-ply web material 452 as is known to those of skill in the art. The combination of web materials to form a multi-ply web material 452 may occur prior to or after the converting of the first web material 152 by the first web converting station 160 or the second web material 252 by the second web converting station 260. FIG. 5 illustrates an embodiment wherein the third web material 352 and the first web material 152 combine to form a multi-ply web material 452.

The first web converting station 160 and second web converting station 260 may convert the respective first web material 152 and second web material 252 in any manner known to those of skill in the art. In one embodiment, at least the first web converting station 160 separates the first web material 152 into discrete portions and winds the discrete portions into discrete elements or logs 154.

In another embodiment, illustrated by example in FIG. 6, the method of the invention may comprise the additional steps of unwinding an additional web material 552 having an additional width 551 and converting this web material 552 with an additional converting station 560. Less than twice the greater of the first width 151, second width 251, or additional width 551 separates the additional web converting station 560 and the first and/or second web converting station 160, 260.

In this embodiment, the relationship of the additional web converting station 560 with the first and/or second web converting stations 160, 260 may be a face-to-face, over-and-under, side-by-side, or angular relationship. As an example the method may comprise the steps of converting a first web material 152 via a first web converting station 160, converting a second web material 252 via a second web converting station 260 disposed in a face-to-face relationship with the first web converting station 160, and converting an additional web material 552 via an additional web converting station 560 disposed in an angular relationship with the first web converting station 160 and the second web converting station 260.

In one embodiment of the method of the invention at least one of the first unwind station 100 and the second unwind station 200 comprises a vertical unwind station and the method comprises the step of unwinding a vertically oriented roll of web material.

Example 1

A surface unwinding station rotates and unwinds a horizontally oriented roll of paper toweling. The roll has a diameter of about 255 cm and a width of about 300 cm. The paper towel web proceeds from the unwind station and acquires an embossed pattern by passing through an embossing station. A winding station imparts spaced lines of weakness to the paper towel web and subsequently winds and separates the web into discrete logs of web material having a width of about 300 cm. The logs of web material proceed to a log saw and are cut into discrete rolls each having a width of about 28 cm.

A roll of polyester film having a diameter of 90 cm and a width of 70 cm and preprinted with indicia related to a paper towel product, unwinds from a horizontally oriented center driven unwind stand. The film proceeds from the unwind station to a film inspection station. An automated machine vision system inspects the film and the preprinted indicia. The inspection station for the polyester film is located directly above the winding station of the paper towel web and less than 150 cm from the winding station. A single operator may efficiently interact with each of the winding station and the inspection station due to the close proximity of the two stations

Example 2

A first unwind station contacts the lower end surface of a vertically oriented first roll of tissue paper having a diameter of about 255 cm and a width of about 300 cm rotating and unwinding the roll. The tissue paper is turned from a vertical orientation to a horizontal orientation via an air bar and proceeds to a first winder. The first winder imparts regularly spaced lines of perforation in the cross-machine direction of the tissue paper and winds the tissue paper into discrete logs.

A second unwind station contacts the lower end surface of a vertically oriented second roll of tissue paper having a diameter of about 255 cm and a width of about 300 cm rotating and unwinding the roll. The second tissue paper is turned from a vertical orientation to a horizontal orientation via an air bar and proceeds to a second winder. The second winder imparts regularly spaced lines of perforation in the cross-machine direction of the tissue paper, winds and separates the tissue paper into discrete logs.

The second winder and the first winder are disposed in a face to face relationship with each other. The first tissue paper in the first winder is separated from the second tissue paper in the second winder by about 590 cm.

A first log conveyor carries the first logs away from the first winder to a first log saw. A second log conveyor running parallel to the first carries the second logs from the second winder to a second log saw.

All documents cited in the Detailed Description of the Invention are, in relevant part, incorporated herein by reference, the citation of any document is not to be considered as an admission that it is prior art with respect to the present invention.

While particular embodiments of the present invention have been illustrated and described, it would have been obvious to those skilled in the art that various other changes and modifications can be made without departing from the spirit and scope of the invention. It is therefore intended to cover in the appended claims all such changes and modifications that are within the scope of the invention.

What is claimed is:

1. A method for converting multiple web materials, the method comprising the steps of:

a) providing a first unwind station, b) unwinding a first web material comprising a first width from a roll of the first web material via the first unwind station, c) slitting the first web material with a first converting operation, d) providing a second unwind station, e) unwinding a second web material comprising a second width from a roll of the second web material via the second unwind station, f) slitting the second web material with a second converting operation, g) providing a web processing station, h) routing the first web material to the web processing station, i) routing the second web material to the web processing station, j) folding the first and second web materials with a third converting operation at the web processing station, k) winding the first web material into a first wound product, and l) winding the second web material into a second wound product different from the first wound product, the first wound product and second wound product being disposed upon a common winding axis, and, wherein at least a portion of the first web material in the web processing station is disposed less than twice the greater of the first width and the second width from at least a portion of the second web material in the web processing station.

2. The method according to claim 1 wherein the web processing station winds the first web material and the second web material about the common winding axis.

3. The method according to claim 1 wherein the first web material is folded into a configuration selected from the group consisting of: a c fold, a z fold and a v fold.

4. The method according to claim 1 further comprising a step of unwinding a vertically oriented roll of the first material.

5. A method for converting multiple web materials, the method comprising the steps of:

a) providing a first unwind station, b) unwinding a first web material having a first width from a roll of the first web material via the first unwind station, c) providing a second unwind station, d) unwinding a second web material comprising a second width from a roll of the second web material via the second unwind station, e) providing a third unwind station, f) unwinding a third web material from a roll of the third web material via the third unwind station into contacting engagement with the first web material, g) providing a web processing station, h) reducing an effective width of the contacted first and third web materials, i) routing the combined first and third web materials to the web processing station, j) winding the contactingly engaged first and third web materials into a first wound product upon a common winding axis, and k) winding the second web material into a second wound product upon the common winding axis, wherein at least a portion of the first web material in the web processing station is disposed less than twice the greater of the first width and the second width from at least a portion of the second web material in the web processing station and the second wound product is different from the first wound product.

6. The method for converting multiple web materials according to claim 5, wherein the step of reducing the effective width of the first web material comprises folding the first web material.

7. The method for converting multiple web materials according to claim 6, wherein the first web material is folded into a configuration selected from the group consisting of a C-fold, a Z-fold, and a V-fold.

8. The method for converting multiple web materials according to claim 5, wherein the contactingly engaged first and third web materials are wound adjacent the second web material.

9. The method for converting multiple web materials according to claim 5, wherein the step of reducing an effective width of the first web material comprises a transverse deformation of the first web material.

10. The method for converting multiple web materials according to claim 5, further comprising the step of unwinding a vertically oriented roll of the first web material.

* * * * *